US009451832B2

(12) United States Patent
Chia

(10) Patent No.: US 9,451,832 B2
(45) Date of Patent: Sep. 27, 2016

(54) MODULAR FURNITURE

(71) Applicant: Geemay Chia, Gates Mills, OH (US)

(72) Inventor: Geemay Chia, Gates Mills, OH (US)

( * ) Notice: Subject to any disclaimer, the term of this patent is extended or adjusted under 35 U.S.C. 154(b) by 97 days.

(21) Appl. No.: 14/536,570

(22) Filed: Nov. 7, 2014

(65) Prior Publication Data

US 2016/0128486 A1 May 12, 2016

(51) Int. Cl.

| | |
|---|---|
| ***A47C 7/00*** | (2006.01) |
| ***A47C 11/00*** | (2006.01) |
| ***A47C 4/02*** | (2006.01) |
| ***A47B 83/02*** | (2006.01) |
| *A47C 3/16* | (2006.01) |
| *A47C 17/04* | (2006.01) |
| *A47D 11/00* | (2006.01) |
| *A47C 13/00* | (2006.01) |

(52) U.S. Cl.

CPC ..... *A47C 11/00* (2013.01); *A47B 83/02* (2013.01); *A47C 4/02* (2013.01); *A47C 3/16* (2013.01); *A47C 13/005* (2013.01); *A47C 17/045* (2013.01); *A47D 11/00* (2013.01)

(58) Field of Classification Search

CPC .... A47C 13/005; A47C 17/045; A47C 3/16; A47D 11/00

USPC ..... 297/440.14, 440.1

See application file for complete search history.

(56) References Cited

U.S. PATENT DOCUMENTS

| | | | | | |
|---|---|---|---|---|---|
| 2,080,982 | A * | 5/1937 | MacDonald | A47B 3/14 | 297/139 |
| 2,693,847 | A | 11/1954 | Kablotsky | | |
| 3,201,894 | A * | 8/1965 | Resch | A63F 9/088 | 273/153 R |
| 3,669,494 | A * | 6/1972 | Lohmeyer | A47C 13/005 | 297/248 |
| 3,738,699 | A * | 6/1973 | Fain | B60P 3/32 | 296/168 |
| 3,773,329 | A | 11/1973 | Sector | | |
| 4,077,666 | A * | 3/1978 | Heumann | A47C 13/005 | 297/248 |
| 5,267,776 | A * | 12/1993 | Fromson | A47C 13/005 | 297/232 |
| 5,540,638 | A * | 7/1996 | Wilkinson | A47C 3/20 | 482/51 |
| 6,063,007 | A | 5/2000 | Sithole | | |
| 7,481,496 | B2 | 1/2009 | Smith | | |
| 7,931,340 | B1 | 4/2011 | Reddick | | |
| 8,109,575 | B2 | 2/2012 | Vitale | | |
| 8,322,793 | B2 | 12/2012 | Chen | | |
| 8,668,271 | B2 | 3/2014 | Genesin et al. | | |
| 2008/0284228 | A1* | 11/2008 | Smith | A47B 83/02 | 297/440.14 |
| 2012/0246823 | A1* | 10/2012 | Conley | A47C 17/045 | 5/12.1 |

OTHER PUBLICATIONS http://www.david-pickett.com/36340/6042479/work/floorscape Fig. 1,5,6.

* cited by examiner

*Primary Examiner* — Chi Q Nguyen

(74) *Attorney, Agent, or Firm* — Ching-Shu Wagner

(57) ABSTRACT

Modular Furniture is an invention directed to, but not limited to, seating, fitting top tables, tumbling, and visual interest. Modular Furniture comprises a plurality of modular seating areas, support surfaces, and top tables. A modular seating area comprises a plurality of modular seating units optionally installed on a support surface. A seating unit comprises a top surface, a bottom surface, and three or more side surfaces between said top surface and said bottom surface. Said top surface has a polygon shape and slants to said bottom surface at an angle to said bottom surface. Said angle is not less than zero degree and not more than forty-five degrees. Pockets are formed by, but not limited to, placing a plurality of seating units in disclosed configurations. The support surface can have legs to lift it off the ground. Top tables have legs fitting among the seating units. Modular Furniture is stackable.

9 Claims, 7 Drawing Sheets

MODULAR FURNITURE

BACKGROUND OF THE INVENTION

This invention generally relates to furniture and, more specifically, to modular furniture.

Various seating systems have been designed to serve the function of bodily support. A number of seating arrangements are based on a conventional sofa of a seating surface with a back support and legs. The seating surface is usually flat, concave, or convex with a fixed surface area; and the back support restricts the orientation of the placement of the furniture. The designs lack visual interest and are not versatile for public displays. Certain furniture has a modular configuration, but the seating surfaces have holes which result in uncomfortable bodily support. Some other designs utilize metal rod modular constructions. However, the basic forms are still composed of a flat seating surface and a back support surface. Some modular seating design has a pivotal connection for ease of storage and transportation, but the seating surface is flat. Some seating arrangement is designed as stepping mattresses which have the same conventional flat surfaces and have similar drawbacks as conventional seating furniture. Some furniture has pockets with slanting surfaces for supine bodily support. However, because of the convexity of the surfaces, a user has to exert energy to stabilize the body on the furniture to keep from sliding off. Some furniture has more than mere flat surfaces and various contours. However, the furniture was specifically designed for two people in intimate encounters and does not have the versatility of public usage and display. Almost all the designs have been based on flat surfaces, or the slanted surfaces were designed for the purpose of modular folding, or the slanted surfaces were created for lying, not for seating. Furthermore, nearly none of the designs allow top table fitting, or give visual interest for public display.

SUMMARY OF THE INVENTION

The present invention of apparatus and methods are directed to, but not limited to, providing seating, providing tumbling surfaces, supporting work top tables, and giving artistic visual interest. The modular furniture has the main component of modular seating areas. The modular seating areas can be installed on the ground or floor, or can be configurable to fit and installed on a support surface and elevated off the ground or floor level. The modular seating area is mainly composed of a group of modular seating units. A modular seating unit is a three dimensional structure including a top surface, a bottom surface, and three or more sides extending between the top surface and the bottom surface. The modular seating unit has generally a polygon shape when viewed from the top surface or the bottom surface. When viewed from the side, the polygon shape of the top surface generally has a high point and a low point. The high point, a vertex-point or a side-line of the polygon shape, is farthest from the bottom surface. The low point, a vertex-point or a side-line of the polygon shape, is closest to the bottom surface. The top surface slants from the high point down to the low point at an angle to the bottom surface. The slant angle is not less than zero degree and not more than forty-five degrees which can be measured from a plane extending from the high point parallel to the bottom surface.

One objective of the present invention of modular furniture is to provide a seating system that has depression pockets generally conforming to body contour. One disclosed embodiment is to group the low points of the top surfaces of modular seating adjacent to the low points of the top surfaces of other modular seating units, and repeat the grouping of the modular seating units in similar configuration. Empty spaces may be filled with cut-up modular seating units to fit the size. The low points form relatively smooth depression pockets conforming to the body contour. The slanting angles of the top surfaces determine the depth of the depression pockets.

Another disclosed embodiment is to group the high points of the top surfaces of the modular seating units adjacent to the high points of the top surfaces of other modular seating units, and repeat the grouping of the modular seating units in similar configuration. Empty spaces may be filled with cut-up modular seating units to fit the size. The grouped high points of the top surfaces of the modular seating units form the high portions of the seating area. The high portions of the seating area provide support for sitters.

A preferred embodiment is to group the low points of the top surfaces of the modular seating units adjacent to the low points of the top surfaces of other modular seating units and group the high points of the top surfaces of the modular seating units adjacent to the high points of the top surfaces of other modular seating units, and repeat the grouping. Modular seating units can be cut to size to fill spaces as desired. When these seating units are grouped as described, they form depression pockets and high portions. The depression pockets and high portions, individually and severally, support various parts of bodies.

Another objective of the present invention of the modular furniture is to provide tumbling surfaces. Because each seating unit has a slanted top surface, when multiple seating units are grouped together, they form generally up and down undulated contours. As these seating units can be made of soft material from some embodiments and placed in undulated contours, they allow tumbling on the seating units, which provides different sensation from tumbling on a flat surface.

Another objective of the present invention of the modular furniture is to provide work surfaces from top tables. Because the modular seating units are repeating, the gaps between the modular seating units are generally also in a repeating pattern. Top tables can be designed to fit between the gaps among the modular seating units. A top table has a flat surface and legs. The flat surface can have any shape including, but not limited to, a shape similar to a modular seating area, support surface, or multiple of polygon shape of the modular seating units. The legs can have any shape including, but not limited to, round, square, rectangular, spindle, or flat. The spacing of the legs should be the width or multiple of the widths of the polygon shape of the modular seating unit measured at the level of the bottom surface plus desired spacing between each modular seating unit. Top tables, removable, can be fitted in any desirable location among the seating units and provide work surfaces.

Another objective of the present invention of modular furniture is to provide visual interest for public display for venues, such as museums and convention halls. From above, the furniture looks like repeating polygon cubes in perspective; from the side, the surfaces of the modular seating units angle and undulate. To further the cube-in-perspective illusion, the angle of the top surface additionally supports that illusion. The whole design intrigues passersby to linger longer which is a very desirable quality in public displays.

The apparatus and methods of the present invention of the modular furniture are further described in the brief descriptions, detailed descriptions, claims, and drawings.

BRIEF DESCRIPTION OF THE DRAWINGS

The disclosed embodiments are illustrated below in brief descriptions and detailed descriptions in exemplary embodiments with many, but not limited, variations.

DETAILED DESCRIPTION OF THE INVENTION

Figure 1:
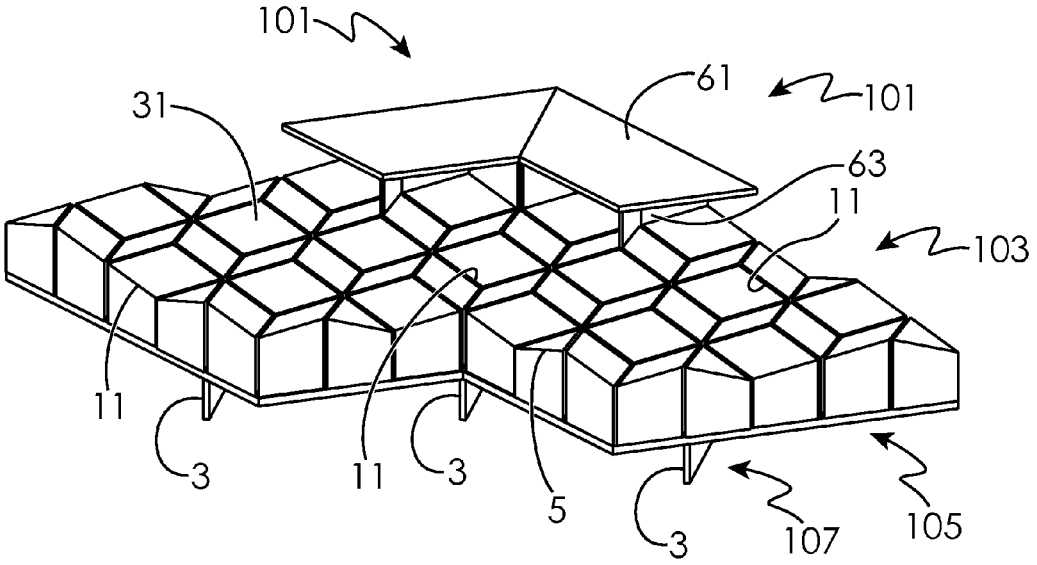
FIG. 1 shows a perspective view of one embodiment of the modular furniture with a seating area installed on support surface with legs underneath the support surface and a top table fitting in the seating area on the support surface.

The characteristics of the inventive modular furniture are highlighted in greater detailed descriptions, with reference to the drawings attached as non-limiting. The disclosed modular furniture comprises a plurality of modular seating areas. A seating area comprises a plurality of modular seating units. Top tables can be fitted among said modular seating units within said seating area. The modular seating units can be installed on the ground or floor, or can be configurable to fit and installed on a support surface and elevated off the ground or floor level. As used herein, the phrase "support surface" is intended to mean what supports modular seating units and top tables. The support surface can have various shapes. To best fit the modular seating units, the support surface should have similar polygon shape, or multiple of the polygon shape, of said modular seating units. Alternatively, the modular seating units can be cut to size to fit within the perimeter of the support surface. The support surface can be lifted off the ground or floor by legs. Support surface legs can have any shape including, but not limited to, round, square, rectangular, spindle, or flat surface and they support top tables, modular seating units, and support surface.

A modular seating unit generally comprises a body made of hard or soft material. Hard material includes, but not limited to, wood, plastic, ceramic, or metal. Soft material is typically made of, but not limited to, foamed rubber or plastic, with or without a stiffening core, such as wood, plastic, or metal, with a covering of various materials, such as fabric, plastics, or leather. The support surface can be made of, but not limited to, wood, plastic, ceramic, or metal. The support surface legs can be made of similar material as support surface. The top tables can be made of similar material as the support surface as well.

One embodiment of modular furniture (FIG. 1) comprises a top table 101, a modular seating area 103, a support surface 105, and support surface legs 107. A modular furniture can be any combination of said components, such as, but not limited to, modular seating area 103 resting on the ground or floor, modular seating area resting on the ground or floor with top tables 101, modular seating area resting on support surface 105, modular seating area resting on support surface with legs 107, modular seating area 103 resting on support surface 105 with top tables 101, and modular seating area 103 resting on support surface 105 with support surface legs 107 and with top tables 101.

As shown in FIG. 1, the disclosed modular furniture herein comprises a support surface 105, a modular seating area 103 on the support surface 105, and a top table 101 fitting among the modular seating area 103 on the support surface 105. As used herein, the phrase "support surface" 105 is intended to mean what supports a modular seating area and top tables. The support surface herein is lifted off the ground by support surface legs 107. The support surface legs herein are flat surface 3.

Also shown in FIG. 1, a modular seating area 103 comprises a plurality of modular seating units 11 configurable to form the modular seating area 103. Modular seating units can be cut to size to fill empty spaces. Herein some modular seating units are cut 5 to fit to the edge of the seating area 103 on the support surface 105. A top table 101 comprises a flat surface 61 and legs 63. Herein the legs of the top table are generally flat 63.

The support surface 105 comprises various shapes. The support surface has the polygon shape, multiple of the polygon shape, or any desirable shape. To best fit the modular seating area 103, the support surface 105 should have similar polygon shape, or multiple of the polygon shape, of the modular seating unit 11. Alternatively, the modular seating units 5 can be cut to fit within the perimeter of the support surface 105. The support surface legs 107 underneath the support surface 105 can be any shape or size as long as they support the support surface, plurality of seating units 11 and plurality of top tables 101.

Figure 2:
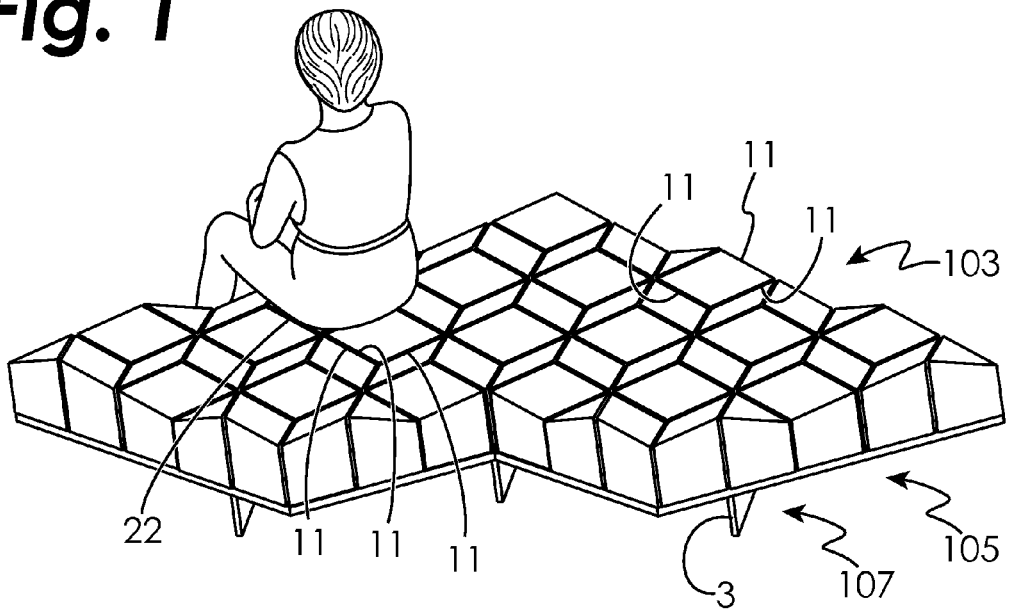
FIG. 2 shows a perspective view with an individual seating in one of the pockets in the seating area.

The embodiment of a modular seating area can seat individuals or objects on the plurality of seating units. FIG. 2 herein shows an individual sitting in one of the depression pockets 22 formed by the disposition of a plurality of modular seating units 11. The support surface herein is with support surface legs 3. A depression pocket 22 is the space above the grouping of modular seating units 11, but the space is lower than the neighboring modular seating units 11. The depression pocket can be formed from one of the disclosed embodiments of the modular seating units 11 as described below in FIG. 3 and FIG. 4.

A modular seating area comprises a plurality of modular seating units. A modular seating unit comprises a top surface, a bottom surface, and three or more side surfaces extending between the top surface and the bottom surface. The top surface generally has a polygon shape including a high point and a low point. The high point, a vertex-point or a side-line of the polygon shape, is farthest from the bottom surface. The low point, a vertex-point or a side-line of the polygon shape, is closest to the bottom surface. The top surface slants toward the bottom surface in an angle not less than zero degree and not more than forty-five degrees measured from a plane passing through the high point parallel to the bottom surface. The bottom surface of the modular seating unit is generally parallel to the ground or floor. The number of side surfaces of modular seating unit is generally the number of the sides of the polygon shape.

Figure 3A:
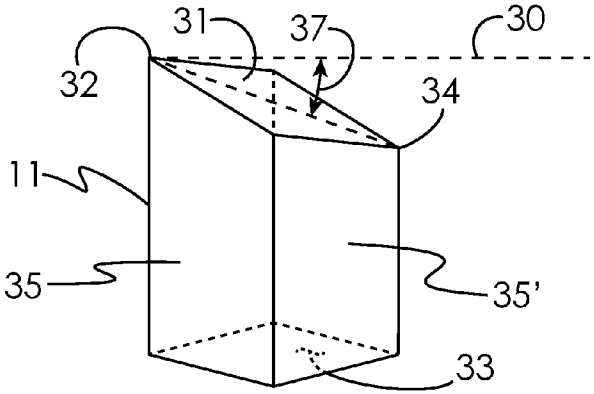
FIG. 3A shows side view of one embodiment of the modular seating unit in a four-sided polygon with the top surface, which includes a high point and a low point, slanting from the high point to the low point at an angle to the bottom surface.

FIG. 3A shows one of the disclosed embodiments of a modular seating unit 11 comprising a top surface 31, a bottom surface 33, and three or more side surfaces 35, 35' extending between the top surface 31 and the bottom surface 33. Herein, the top surface 31 has a four-sided polygon shape. The bottom surface 33 has a four-sided polygon shape. The four-sided polygon shape herein has two acute angles and two obtuse angles. The side surfaces are substantially vertical between said top surface 31 and said bottom surface 33. Said top surface 31 has a high point 32, herein a vertex-point, which is farthest from said bottom surface 33 and a low point 34, herein a vertex-point, which is closest to said bottom surface 33. Said top surface 31 herein has a slanting angle 37 of not less than zero degree and not more than forty-five degrees from said high point 32 down toward said low point 34 in reference to a plane 30 extending from said high point 32 parallel to said bottom surface 33.

Figure 3B:
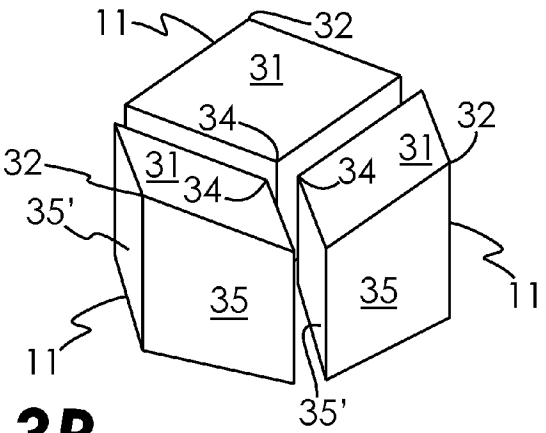
FIG. 3B shows the low points of the top surfaces of a plurality of the modular seating units disposed adjacent to the low points of the top surfaces of another said plurality of said modular seating units to form a depression pocket.

A plurality of modular seating units 11, shown in FIG. 3A, can be disposed in any configuration. FIG. 3B discloses one embodiment of disposition of plurality of modular seating units. The plurality of modular seating units of FIG. 3A are grouped with said low point 34 of said top surface 31 of a first one of said plurality of modular seating units disposed adjacent to said low point 34 of said top surface of a second one of said plurality of modular seating units and adjacent to said low point 34 of said top surface of a third one of said plurality of modular seating units. Said low points of said top surfaces of said plurality of modular seating units disposed adjacent to said low points of said top surfaces of said plurality of modular seating units generally form depression pockets for bodily supports in the modular seating area.

Figure 3C:
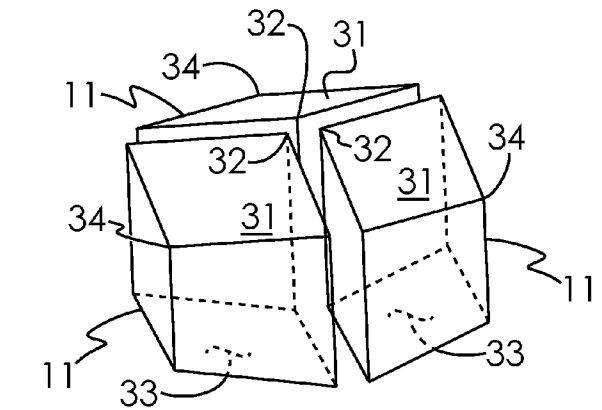
FIG. 3C shows the high points of the top surfaces of a plurality of the modular seating units disposed adjacent to the high points of the top surfaces of another said plurality of said modular seating units to form a high portion.

FIG. 3C discloses another embodiment of disposition of modular seating units. The plurality of modular seating units of FIG. 3A are grouped with said high point 32 of said top surface 31 of a first one of said plurality of modular seating units disposed adjacent to said high point 32 of said top surface of a second one of said plurality of modular seating units and adjacent to said high point 32 of said top surface of a third one of said plurality of modular seating units. Said high points of said top surfaces of said plurality of modular seating units disposed adjacent to said high points of said top surfaces of said plurality of modular seating units form high portions of the seating area. The high portions of said seating area provide bodily supports.

Figure 3D:
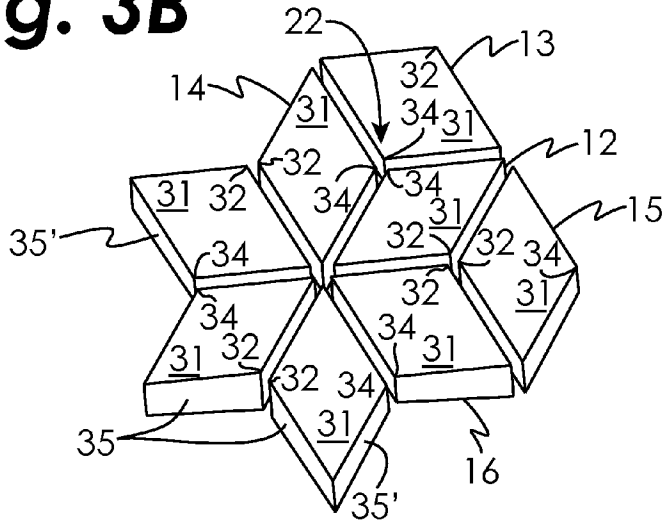
FIG. 3D shows the low point of the top surface of first one of a plurality of modular seating units disposed adjacent to the low point of the top surface of second one of said plurality of said modular seating units, the high point of said top surface of said first one of said plurality of said modular seating units disposed adjacent to the high point of the top surface of third one of said plurality of said modular seating units, and the repeating of grouping the low points of the top surfaces of said plurality of said modular seating units disposed adjacent to low points of the top surfaces of other said plurality of said modular seating units, and high points of the top surfaces of said plurality of said modular seating units disposed adjacent to the high points of the top surfaces of other said plurality of said modular seating units.

FIG. 3D discloses preferred embodiment of disposition of modular seating units. The plurality of modular seating units of FIG. 3A are grouped with said low point 34 of said top surface 31 of a first one 12 of said plurality of modular seating units disposed adjacent to said low point 34 of said top surface 31 of a second one 13 of said plurality of modular seating units, and said high point 32 of said top surface 31 of said first one 12 of said plurality of modular seating units disposed adjacent to said high point 32 of said top surface 31 of a third one 15 of plurality of modular seating units. Said low points 34 of said top surfaces 31 of said plurality of modular seating units 12, 13, 14 form a depression pocket of the seating area. Said high points 32 said top surfaces 31 of said plurality of modular seating units 12, 15 16 form a high portion of said seating area.

Figure 4:
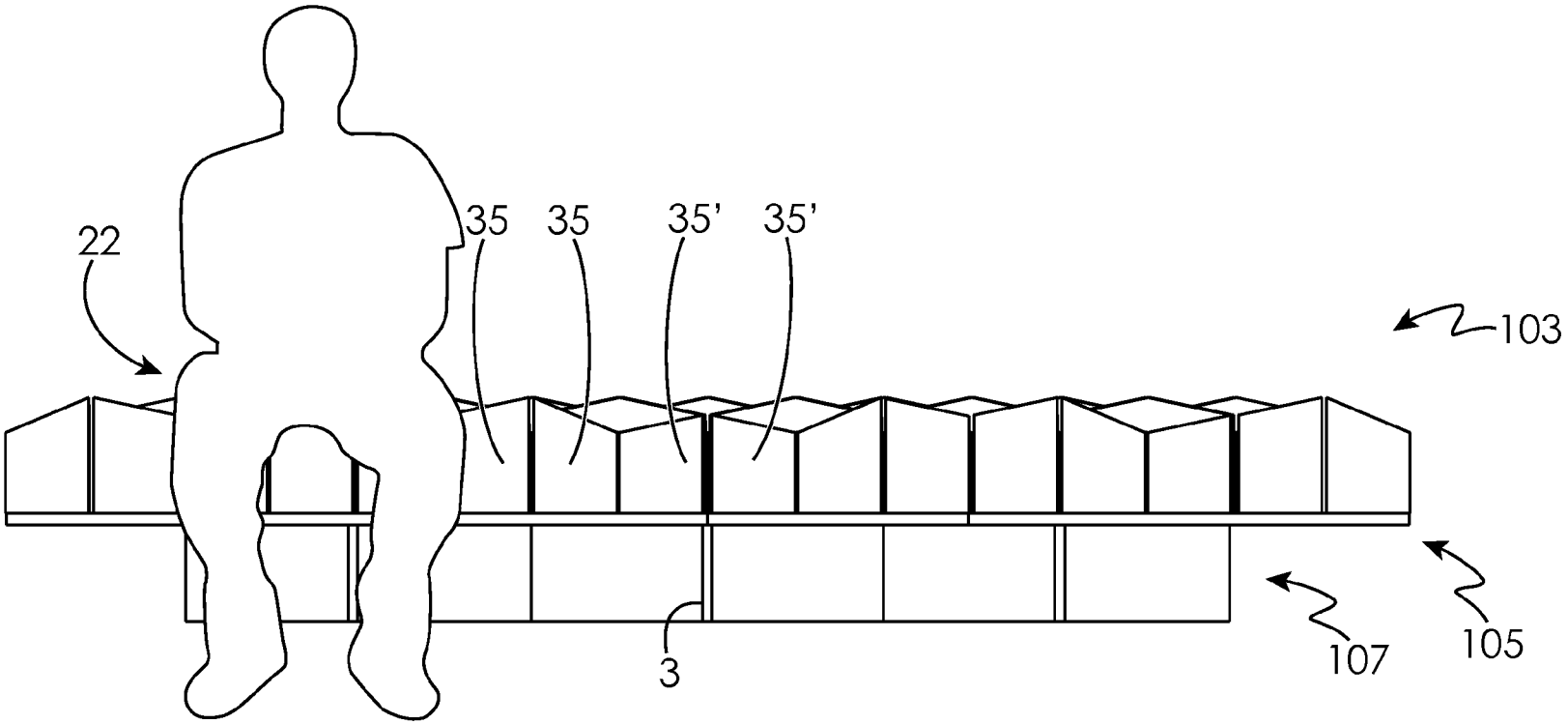
FIG. 4 shows side view of one of the disclosed embodiments with an individual seated in the depression pocket.

FIG. 4 shows side view of one disclosed embodiment with an individual sitting in the depression pocket. Said low points 34 of said top surfaces 31 of said plurality of modular seating units FIG. 3A herein disclosed in FIG. 3B, 3C, 3D are disposed to form a depression pocket 22 wherein an individual sits as shown in FIG. 4. A seating area 103 is disposed on top of support surface 105. Said seating area and said support surface are supported by support surface legs 107, which herein are flat 3.

Figure 5:
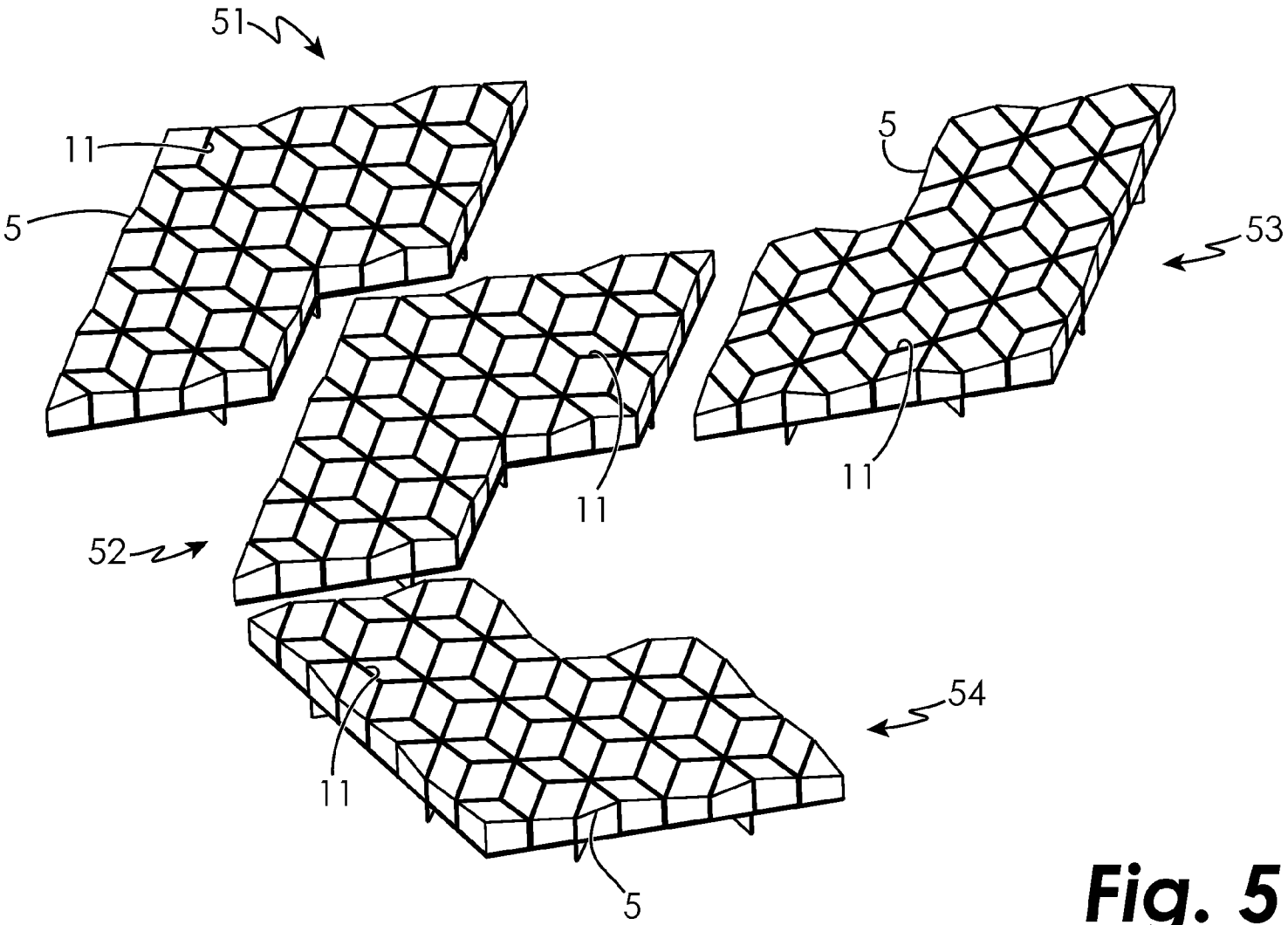
FIG. 5 shows perspective view disclosing embodiments of the modular seating areas as modular and flexible to allow users to rearrange and form various compositions.

A plurality of seating areas 103 can be disposed in any configuration. FIG. 5 shows some possible configurations 51, 52, 53, 54. A plurality of seating areas can be parallel to one another, rotated in relation to one another, or opposite to one another. The versatility of configuration is important in public or private displays. Modular seating units may be cut in size to fit empty spaces from grouping plurality of modular seating units 11. Herein cut modular seating units 5 generally fill the edges of said plurality of seating areas.

Figure 6:
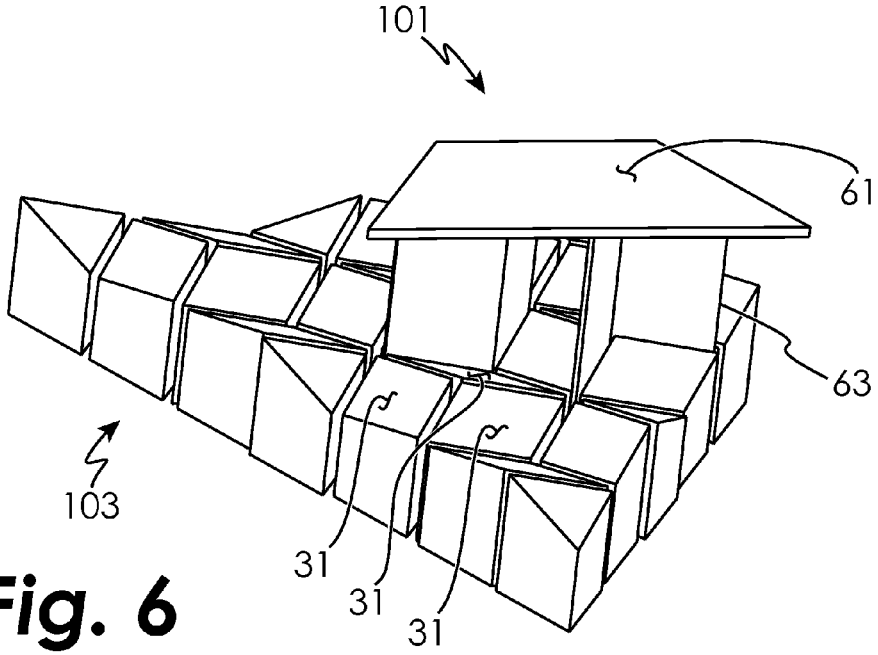
FIG. 6 shows one embodiment of a top table with legs fitting among the modular seating units of the seating area.
Figure 7:
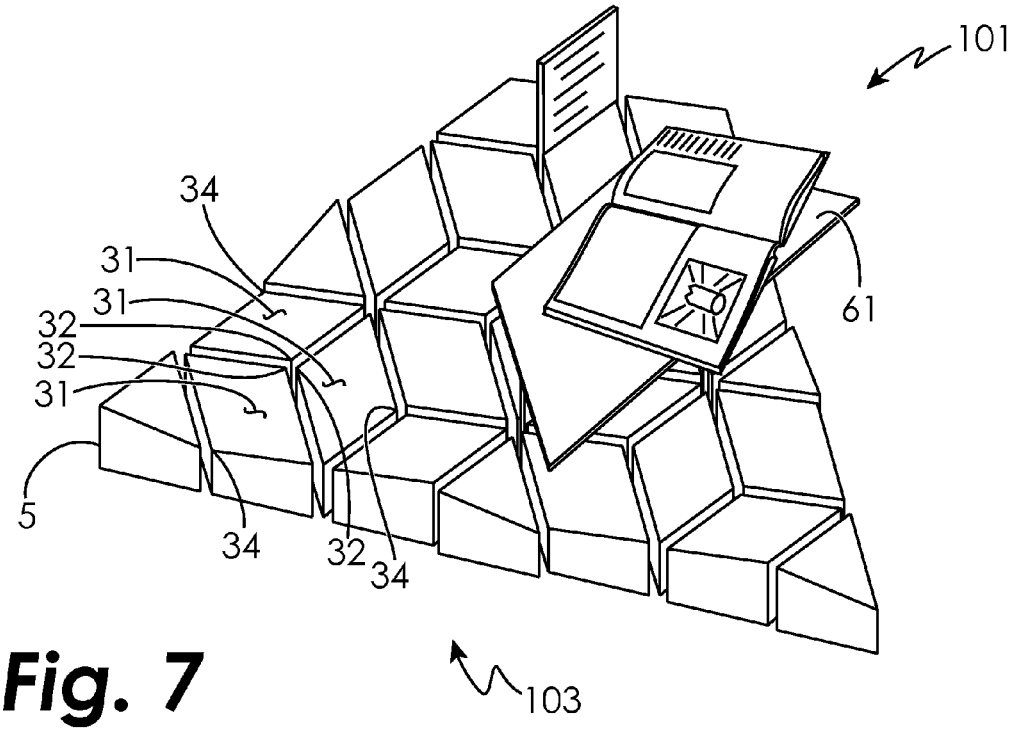
FIGS. 7-9 show top tables fitting in the seating areas in various configurations for use.
Figure 8:
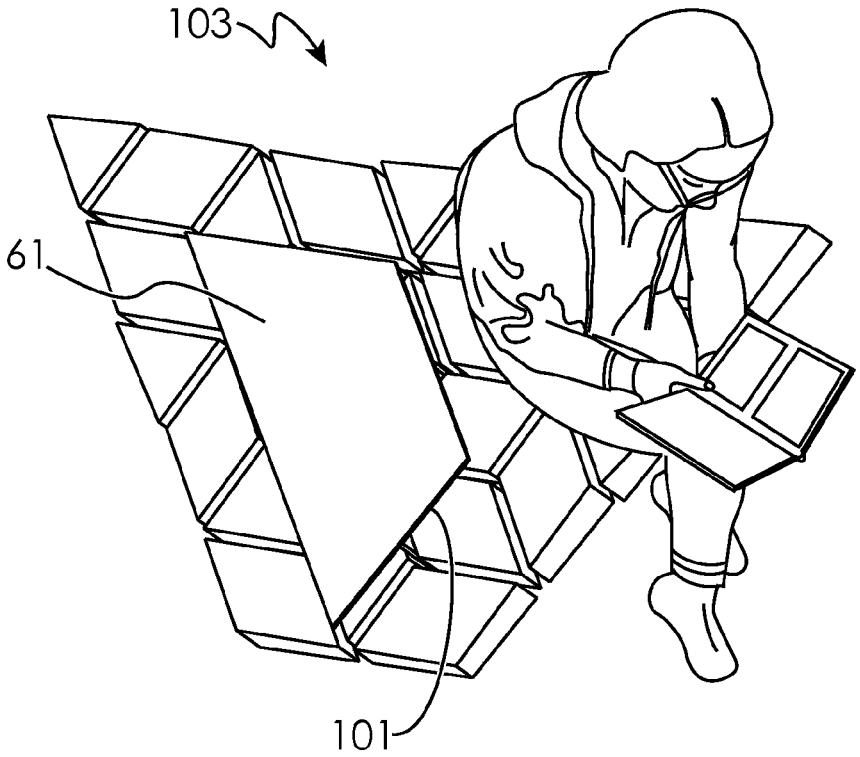
Figure 9:
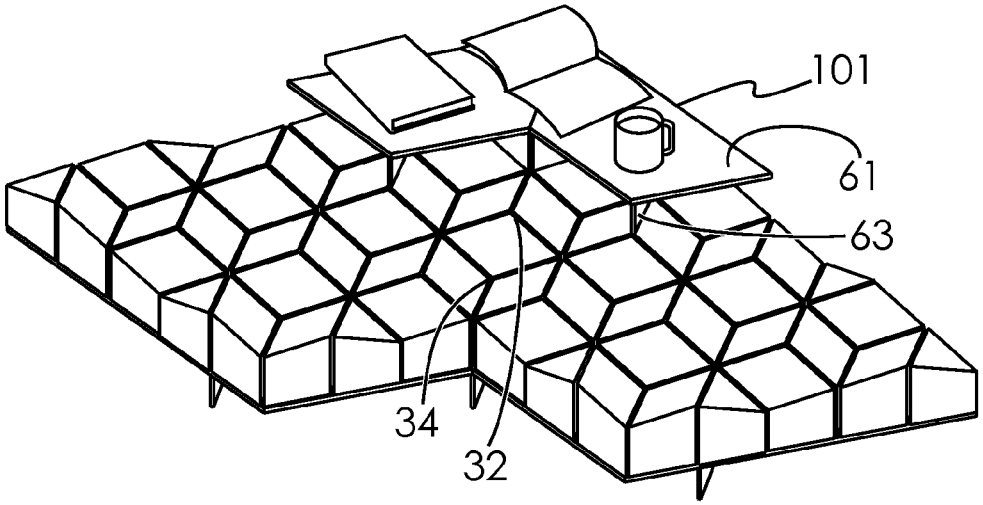

FIG. 6 illustrates the configuration of a top table 101 disposed on seating area 103. The flat surface 61 of a top table can be repetition of the polygon shape 31 of the modular seating units, or any other shape. The flat surface 61 of a top table can be similar to the shape of the support surface, but with a smaller dimension. The legs 63 can have any shape including, but not limited to, round, square, rectangular, spindle, or flat. The spacing between the legs 63 beneath said top table should have the width of the polygon shape 31, or multiple of the polygon shape, measured at the level of bottom surface, plus desired space between said modular seating units to fit among a plurality of modular seating units. Variations of the top table arrangements are illustrated, but not limited to, FIG. 7, 8, 9.

Figure 10A:
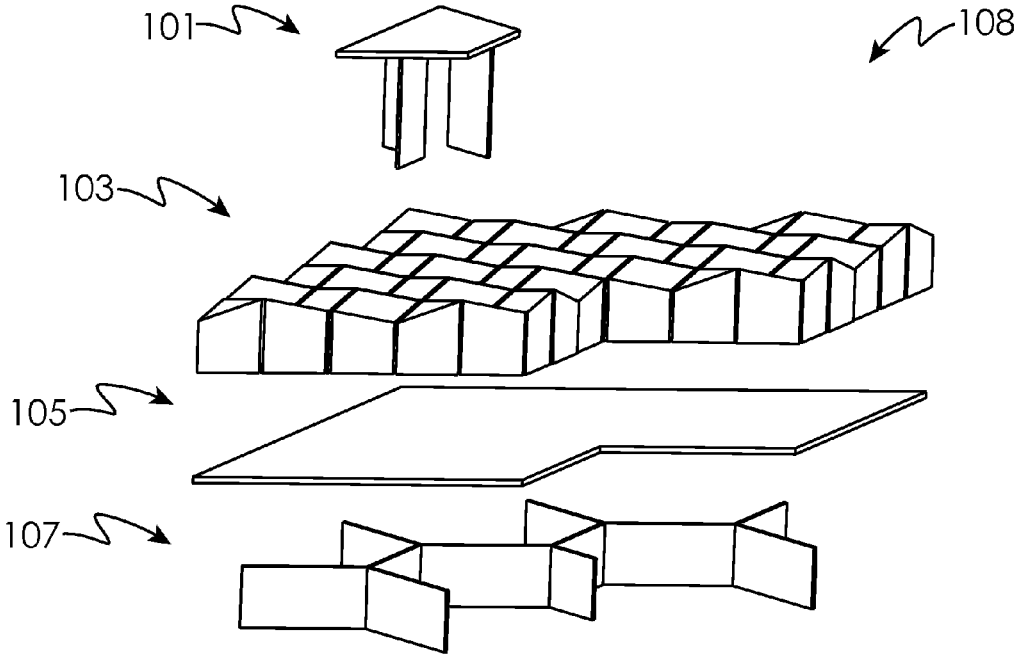
FIG. 10A shows configuration of top table, seating area, support surface, and legs, with the disclosed embodiments being stackable.
Figure 10B:
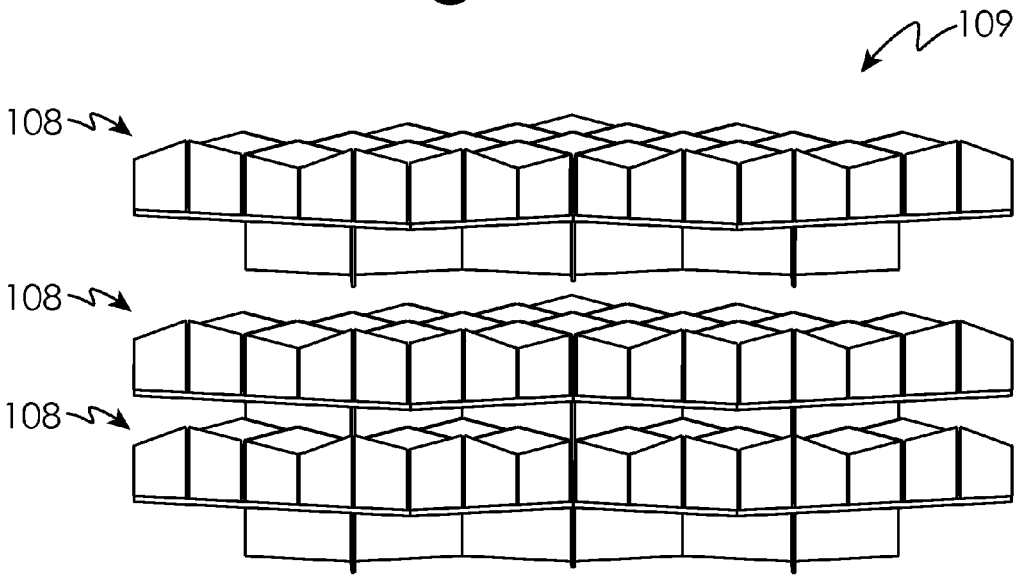
FIG. 10B shows the stacking of disclosed modular furniture as a plurality of modular seating areas on their support surfaces, herein with support surface legs.

FIG. 10A discloses the assembly of a top table 101, a seating area 103, support surface 105, and support surface legs 107. Stackable modular furniture 108 comprises seating area 103, support surface 105, and herein support surface legs 107. FIG. 10B shows the stacking of disclosed modular furniture 109 as a plurality of modular seating areas on their support surfaces, herein with support surface legs 108.

One embodiment of modular furniture was carried out in the following fashion. The dimensions of a modular seating area, support surface and a plurality of modular seating units of the modular furniture were designed on 3D Autodesk Alias®. Top views of said designs were sketched on Sketchbook Pro® software. Desirable angles and lengths of the polygon shape of said seating units were determined using geometry calculations. A relative lower sofa couch was chosen for the height of support surface legs in this particular project. A 4×8 ft birch plywood from Home Depot® and 6" thick foam from an upholstery store were utilized. Table saw and band saw were used to cut the plywood into the shape of support surface and support surface legs. Notches were cut into the support surface legs to connect into the support surface. Holds were cut by a Dremmel® moto-tool under the support surface for the notches of the support surface legs to fit in and be secured with wood glue. Using a band saw, the foam was cut into four-sided polygons herein with two 60 degree angles opposite to each other and two 120 degree angles opposite to each other. A rig was used to tilt the band saw table herein at 20 degrees to properly attach the four-sided-polygon-shaped foams to cut the angles on the top surface of the modular seating units. After cutting all the angled pieces, some foam modular seating units were cut herein in half to allow the foams to be fitted along the edges of the support surface. Glue spray was used to mount the bottom surface of said foam seating units to the support surface after arranging them to the desired shape. The top tables were assembled in similar way as the support surface and support surface legs. Special attention was put on the spacing of the legs of said top tables. The spacing should be multiple width of the polygon shape of said modular seating units measured at the level of the bottom surface plus the desired space between said modular seating units.

Other embodiments of the modular furniture can be made in different polygon shapes and angles. Different methods can be used to attach modular seating units to the support surface and if desired, between said modular seating units. These can be accomplished by, but not limited to, using Velcro®, magnet, tapes, strings, hooks. Support surface legs can be attached to the support surface by additional plywood strips underneath the surface forming grooves to fit the legs. Top table legs can be attached to the flat surface of a top table in similar fashions.

The invention claimed is:

1. A modular seating area comprising:

a plurality of modular seating units configurable to form said modular wherein said modular seating units comprising:

a bottom surface comprising a first polygon shape;

a top surface comprising said a second polygon shape wherein said top surface includes a high point and a low point wherein said high point comprising a vertex-point or a side-line of said polygon shape farthest from said bottom surface, and said low point comprising a vertex-point or a side-line of said polygon shape closest to said bottom surface; and side surfaces coupling said top and bottom surfaces wherein said top surface slants from said high point toward said low point at an angle to said bottom surface wherein said angle is not less than zero degree and not more than forty-five degrees.

2. The modular seating area of claim 1, wherein said angle is more than zero degree and less than forty-five degrees.

3. The modular seating area of claim 1, wherein said polygon shape is non-rectangular.

4. The modular seating area of claim 3, wherein said angle is more than zero degree and less than forty-five degrees.

5. The modular seating area of claim 3, further comprising a top table comprising:

a flat surface; and a plurality of top table legs extending underneath said flat surface wherein said top table legs are spaced by at least one said polygon shape measured at said bottom surface and fitted among said modular seating units.

6. The modular seating area of claim 1, further comprising a top table comprising:

a flat surface; and a plurality of top table legs extending underneath said flat surface wherein said top table legs are spaced by of at least one said polygon shape measured at said bottom surface and fitted among said modular seating units.

7. A method of forming a modular seating area comprising:

grouping a plurality of modular seating units configurable to form said modular seating area wherein said modular seating units comprising:

a bottom surface comprising a first polygon shape;

a top surface comprising said a second polygon shape wherein said top surface includes a high point and a low point wherein said high point comprising a vertex-point or a side-line of said polygon shape farthest from said bottom surface, and said low point comprising a vertex-point or a side-line of said polygon shape closest to said bottom surface; and side surfaces coupling said top and bottom surfaces wherein said top surface slants from said high point toward said low point at an angle to said bottom surface wherein said angle is not less than zero degree and not more than forty-five degrees.

8. The method of forming a modular seating area in claim 7, wherein grouping a plurality of modular seating units further comprising:

grouping said high point of said top surface of a first said modular seating unit adjacent to said high point of said top surface of a second said modular seating units, and said high point of said top surface of said first modular seating unit adjacent to said high point of said top surface of a third said modular seating units; and repeating the grouping of said high points of said top surfaces of said plurality of modular seating units adjacent to said high points of said top surfaces of other said plurality of modular seating units.

9. The method of forming a modular seating area in claim 7, wherein grouping a plurality of modular seating units further comprising:

grouping said low point of said top surface of a first said modular seating units adjacent to said low point of said top surface of a second said modular seating units, and said low point of said top surface of said first modular seating units adjacent to said low point of said top surface of a third said modular seating units; and repeating the grouping of said low points of said top surfaces of said plurality of modular seating units adjacent to said low points of said top surfaces of other said plurality of modular seating unit.

* * * * *